US006899512B2

(12) United States Patent
Roth

(10) Patent No.: US 6,899,512 B2
(45) Date of Patent: May 31, 2005

(54) BOTTOM SHEET INSERTER

(75) Inventor: Curtis A. Roth, Post Falls, ID (US)

(73) Assignee: J & L Development, Inc., Keithville, LA (US)

( * ) Notice: Subject to any disclaimer, the term of this patent is extended or adjusted under 35 U.S.C. 154(b) by 29 days.

(21) Appl. No.: 10/087,727

(22) Filed: Feb. 26, 2002

(65) Prior Publication Data

US 2003/0161712 A1 Aug. 28, 2003

Related U.S. Application Data

(63) Continuation-in-part of application No. 09/632,828, filed on Aug. 7, 2000, now abandoned.

(51) Int. Cl.[7] ..... B65G 57/00
(52) U.S. Cl. ..... 414/789.5; 414/788.1
(58) Field of Search ..... 414/788.1, 789.5

(56) References Cited

U.S. PATENT DOCUMENTS

| | | | | |
|---|---|---|---|---|
| 5,135,351 | A | 8/1992 | Rathert | |
| 5,336,041 | A | 8/1994 | Seidel et al. | |
| 5,375,967 | A | * 12/1994 | Rathert | 414/789.5 |
| 5,419,677 | A | 5/1995 | Cohn | |
| 6,241,233 | B1 | 6/2001 | DeVlaam | |

* cited by examiner

*Primary Examiner*—Donald W. Underwood
(74) *Attorney, Agent, or Firm*—Wells St. John P.S.

(57) ABSTRACT

A bottom sheet inserter is described in which a conveyor is provided on a frame that defines a path for a load. The conveyor is operable to move the load in a forward direction along the path. A bottom sheet insertion station is situated between first and second conveyor flights which support and move a load in a forward direction. A bottom sheet feeder is operable to feed a bottom sheet through the bottom sheet insertion station and under the load as the load moves from the first flight and onto the second flight.

22 Claims, 17 Drawing Sheets

BOTTOM SHEET INSERTER

CROSS REFERENCE TO RELATED APPLICATION

The present application is a continuation-in-part of parent application Ser. No. 09/632,828, filed Aug. 7, 2000 (now abandoned) which is incorporated by reference into the present application.

TECHNICAL FIELD

The present invention relates to apparatus and processes for placing a bottom sheet below a load.

BACKGROUND OF THE INVENTION

It is often desirable to place a sheet of material such as corrugated board under a load to protect the load against damage from lifting, transport or other handling operations.

Loads may either be too heavy to lift for placement of a bottom sheet, or it may be undesirable to interrupt progress of loads being transported for placement of bottom sheets.

Further, some loads such as stacked materials may become disheveled if lifted or otherwise shifted to allow access for placement of a bottom sheet. The stacked material in the load may shift or topple if lifted from an end or a side. Further, full access to the area under the load may not be permitted unless the entire load is lifted to provide clearance for placement of the bottom sheet or sheets.

Of course, loads may be formed on bottom sheets that are set in position before the load is formed. However, the sheets are often not of substantial weight and can easily shift position before the load is received. Further, the bottom sheet may interfere or disrupt a load accumulation process, especially in situations where the load is progressively formed in a stack.

BRIEF DESCRIPTION OF THE DRAWINGS

Preferred embodiments of the invention are described below with reference to the following accompanying drawings.

FIG. 6 is a fragmented cross-sectional view taken substantially along line 6—6 in FIG. 5 showing movement of the bottom sheet along the bottom sheet transport;

FIG. 7 is a view similar to FIG. 6 only showing the bottom sheet in position below a conveyor;

FIG. 8 is a cross-sectional view taken along line 8—8 with a load on the conveyor above;

FIG. 10 is a view similar to FIG. 9 only showing further progress of the bottom sheet under the forwardly moving load;

FIG. 12 is a view similar to FIG. 11 only showing the conveyor pivoted upwardly to allow access to the bottom sheet feeder below;

FIG. 13 is a perspective view of another preferred form of the bottom sheet inserter with a pair of bottom sheets positioned to one side thereof;

FIG. 14 is a view similar to FIG. 13 only showing the bottom sheets in position in the bottom sheet receiver;

FIG. 16 is a view similar to FIG. 15 only showing the load progressively moving along the forward path to the bottom sheet insertion station and actuating the bottom sheet feeder;

FIG. 17 is a view similar to FIG. 16 only showing the load moving past the bottom sheet insertion station where the bottom sheet is being moved simultaneously under the load; and FIG. 18 is a sectioned view taken substantially along line 18—18 in FIG. 16.

DETAILED DESCRIPTION OF THE PREFERRED EMBODIMENTS

Figure 1:
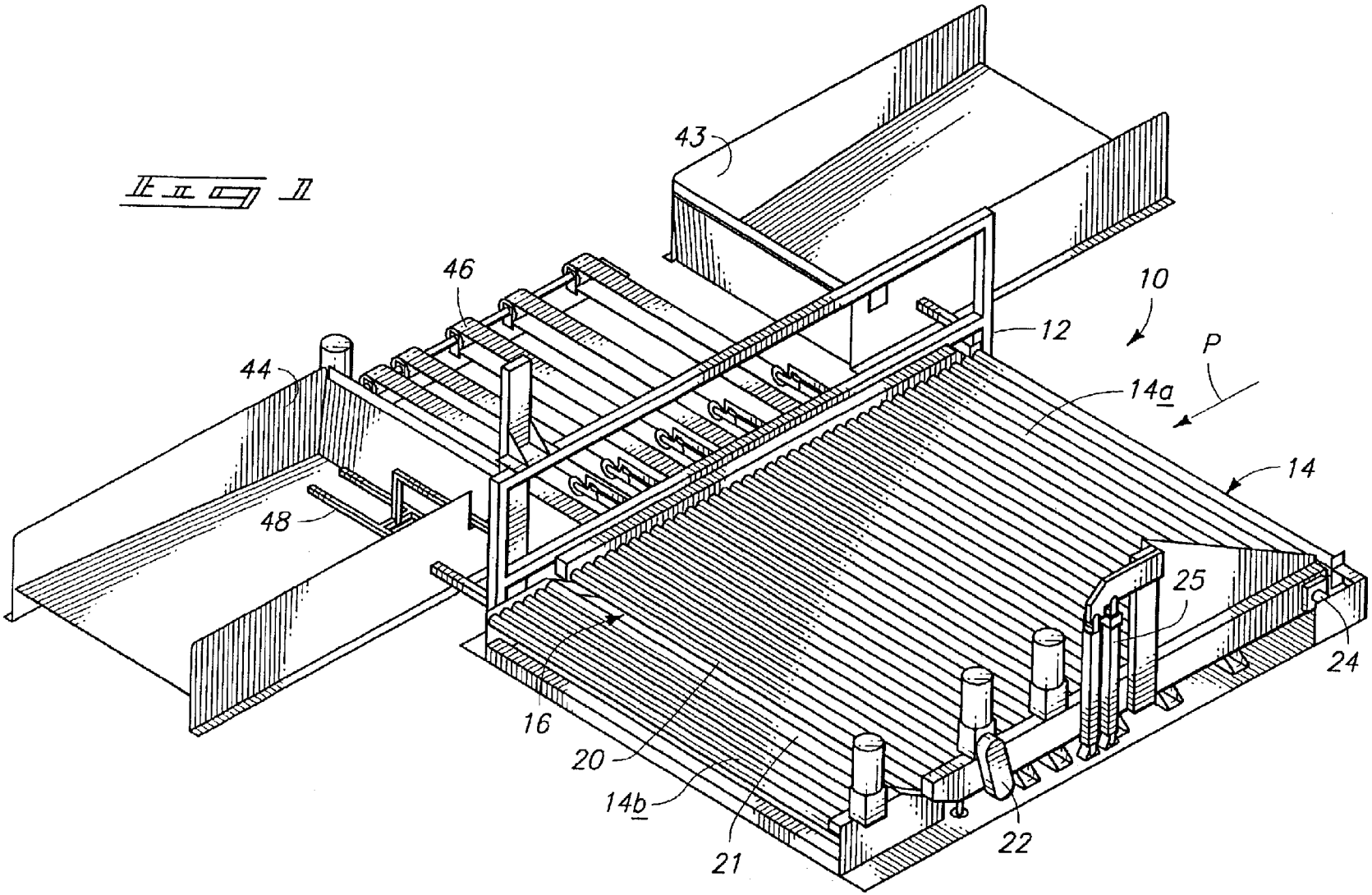
FIG. 1 is a perspective view of a bottom sheet inserter of a preferred form.
Figure 2:
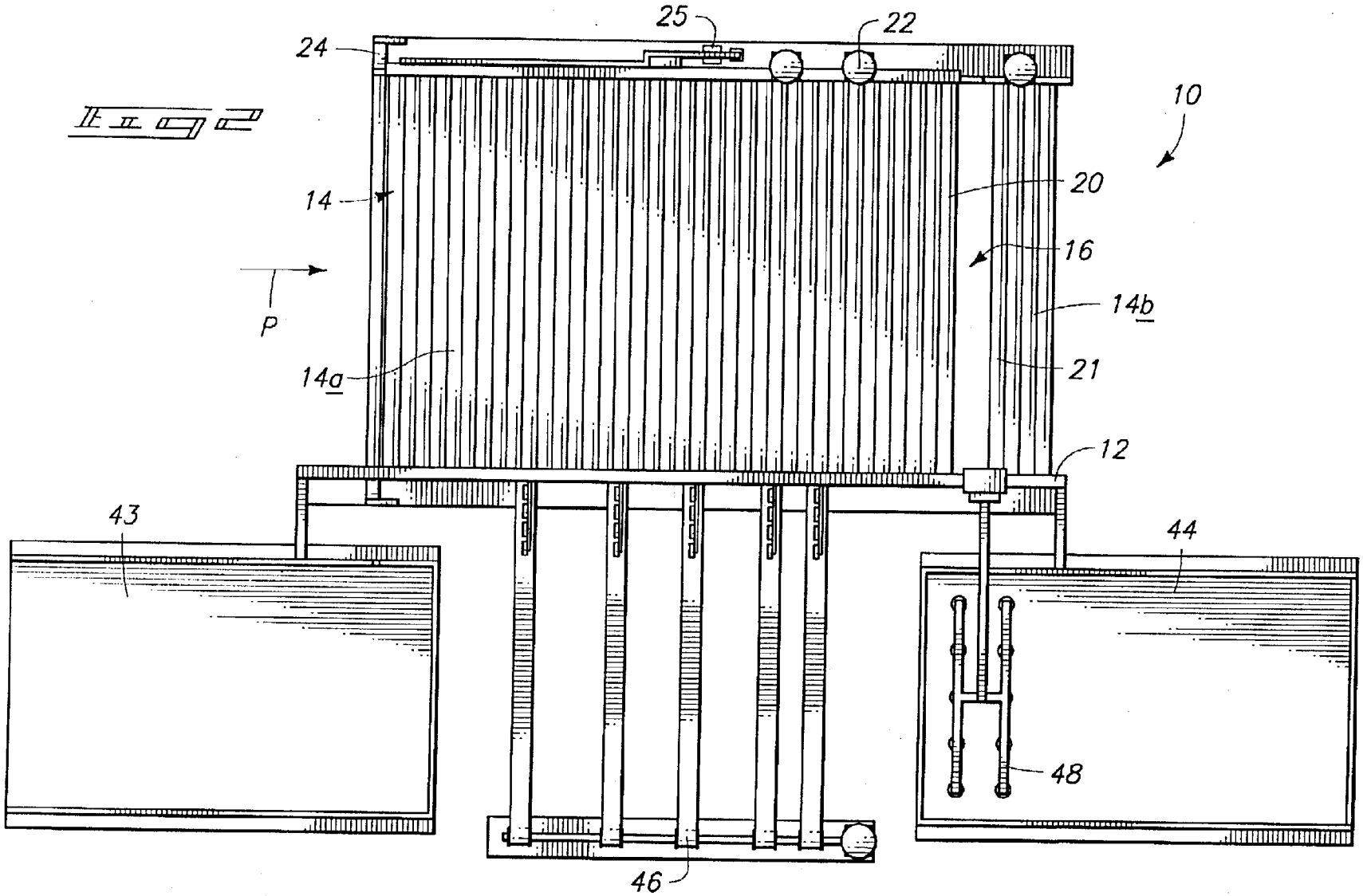
FIG. 2 is a top plan view of the preferred bottom sheet inserter as seen from above in FIG. 1.

This disclosure of the invention is submitted in furtherance of the constitutional purposes of the U.S. Patent Laws "to promote the progress of science and useful arts" (Article 1, Section 8).

Before describing elements of the preferred embodiments of the invention in detail, general aspects of the invention will be given below.

Preferred aspects of the present bottom sheet inserter are generally illustrated in the drawings and are designated therein by the reference numeral 10. In a first aspect, the bottom sheet inserter 10 includes a frame 12 with a first conveyor flight 14*a* defining a path P for a load L and operable to move the load in a forward direction along the path to a bottom sheet insertion station 16. A second conveyor flight 14*b* is provided on the frame 12 along the path P and downstream of the bottom sheet insertion station 16, and is operable to move the load L in the forward direction from the bottom sheet insertion station 16. A bottom sheet feeder 18 is situated adjacent the bottom sheet insertion station 16 and is operable to feed a bottom sheet from the bottom sheet insertion station onto the second conveyor flight and under a load moving onto the second conveyor flight 14*b*.

Another aspect involves a process for inserting a bottom sheet S below a load L, including moving the load L on a first conveyor flight 14*a* along a path P in a forward direction to a bottom sheet insertion station 16. The load L is moved past the bottom sheet insertion station and onto a second conveyor flight 14*b* downstream of the first conveyor flight 14*a*, and a bottom sheet S is progressively moved under the load from the bottom sheet insertion station 16 as the load L moves onto the second conveyor flight 14*b* such that the load L becomes supported on the bottom sheet S and the bottom sheet S becomes supported on the second conveyor flight 14*b*.

In a further aspect, the bottom sheet inserter 10 includes a frame 12 and a conveyor 14 on the frame, including first and second conveyor flights 14*a*, 14*b* that define a path for a load L and that are operable to move the load L in a forward direction along the path and substantially in a plane. A bottom sheet insertion station 16 is situated along the conveyor 14 between the first and second conveyor flights

14*a*, 14*b*. A bottom sheet receiver 17 is located adjacent the bottom sheet insertion station 16 and is configured to receive and orient a bottom sheet S through the bottom sheet insertion station 16 in the path P of a load on the conveyor 14 with a leading edge of the bottom sheet projecting above the plane and a trailing edge situated below the plane. A bottom sheet feeder 18 is situated adjacent the receiver 17 and is operable to feed the bottom sheet onto the second conveyor flight 14*b* and beneath the load L.

Another aspect includes a process for inserting a bottom sheet S below a load L including moving the load L on a first flight 14*a* of a conveyor 14 along a plane X in a forward path of travel. A bottom sheet S is placed through a bottom sheet insertion station 16 and under the first flight 14*a* and with a leading edge E of the bottom S sheet projecting above the plane X and in the forward path P. The bottom sheet S is engaged by the load L, which moves the bottom sheet against a second conveyor flight 14*b* that extends forwardly of the first flight 14*a* from the bottom sheet insertion station 16. The bottom sheet is moved progressively under the load L and onto the second flight 14*b* as the load L moves along the forward path of travel such that the load becomes supported on the bottom sheet S and second flight 14*b*.

More specific details of the preferred embodiments will now be described, starting with a description of the conveyor 14 and ending with operation of the invention as related to steps in the preferred process.

As shown in FIGS. 1–12 of the drawings, an exemplary preferred form of the conveyor 14 is shown as a roller conveyor mounted to the frame 12, though other conveyor forms (such as the belt conveyor shown in FIGS. 13–18 could also be used). The conveyor 14 in general is provided to move a load L such as the stack of sheets shown in the drawings, in the forward path P and preferably along a plane X. In preferred forms, the conveyor 14 further includes first and second flights 14*a*, 14*b* that are preferably aligned along the plane X.

The bottom sheet inserter station 16 in the FIGS. 1–12 embodiment is defined between successive rollers 20, 21 on the roller conveyor. Station 16 in the belt type conveyor version is situated between intermediate belt rollers 65, 67.

The conveyor 14 in either form may be operated by appropriate conventional drive mechanisms, such as a motor and drive linkage 22 connected to rotate the rollers or belt and thereby move loads L supported thereon in the forward direction of travel and along the path P. The top surface of the rollers or the top belt surfaces define the plane X, along which the successive loads L are supported.

It should be understood although the flights 14*a*, 14*b* are shown to be substantially horizontal, that other angular orientations could be used. It should also be noted that the plane X need not specifically be common to both conveyor flights 14*a* and 14*b*. One flight could be somewhat angularly offset with respect to the other.

The motor and drive linkage 22 may be operated continuously if desired, to move successive loads along the path P at a constant or variable velocity, during which time steps may be performed to place one or more bottom sheets under the successive loads. The forward progress of the loads for the FIGS. 1–12 arrangement need not be interrupted for the purpose of placing bottom sheets beneath the successive loads. On the other hand, if the bottom sheets S are to be manually placed, as with the machine and process exemplified by FIGS. 13–18, temporary interruption of the forward load travel may be desirable.

It is preferable that the bottom sheets S be inserted under the loads S from below the working flight(s) of the conveyor 14 (more specifically, the flights 14*a*, 14*b*). Thus, the bottom sheet feeder 18 is preferably situated to accomplish this function. More specifically, the bottom sheet feeder 18 in the FIGS. 1–12 form is preferably positioned below the conveyor 14 and upstream of the bottom sheet insertion station 16.

The conveyor 14 in the FIGS. 1–12 form may be made to move about a pivot point 24 (FIGS. 1 and 2) to provide access to the bottom sheet feeder 18 for maintenance and repair (see FIG. 12). A lift 25 may also be provided to selectively shift the conveyor 14 to an open position as demonstrated in FIG. 12 to permit access to the bottom sheet feeder 18 below.

In the FIGS. 1–12 version, the preferred bottom sheet feeder 18 includes a feed drive 28 positioned to move a bottom sheet S in the forward direction through the sheet insertion station 16. In the preferred form shown, the bottom sheet feeder 18 is situated below the conveyor 14 and includes the feed drive 28 and a sheet lift 32. Both drive 28 and lift 32 are positioned to move bottom sheets upwardly and in the forward direction through the sheet insertion station 16.

More specifically, the exemplified feed drive (FIGS. 9–12) includes a set of driven rollers 34 mounted on the frame below the conveyor, with the sheet lift 32 being positioned below the rollers 34 to move a bottom sheet upwardly against the driven rollers 34. Thus, bottom sheets may be engaged and moved by the driven rollers 34 in a forward direction through the sheet insertion station 16. The driven rollers 34 may be operated by the same drive mechanism 22 used for the conveyor 14.

The sheet lift 32 may be comprised of a further set of rollers 36 that are mounted to a lift beam 38 that is pivotably mounted at one end to the frame 12. A selectively inflatable pneumatic lift bladder 40, or other appropriate lifting device such as a ram cylinder, solenoid, or the like is mounted between the frame or ground surface and the beam 38. Upon expansion, the bladder 40 will cause the beam 38 to swing upwardly, lifting the rollers 36 against the sheet and lifting the leading edge thereof into engagement with the driven rollers 34. The rotating rollers will thus move the engaged sheet forwardly and upwardly toward the bottom sheet insertion station 16.

Also, as part of the preferred bottom sheet feeder 18, a leading edge deflector 42 may be provided. The deflector 42 may be comprised of an inclined plate (FIGS. 9–12) leading from the bottom sheet insertion station 16 upstream to a location just downstream of the feed drive 28. The deflector may be secured in a stationary position on the frame to engage and deflect the leading edges of bottom sheets (that are moved forwardly by operation of the driven rollers 34) upwardly and through the sheet insertion station 16 and under a load simultaneously moving past the station.

The sheet lift 32 and the preferred mechanism described above is provided to allow variability or selection of placement for bottom sheets below loads L that travel past the insertion station 16. Appropriate timing or sensing apparatus may be used to cause advanced or retarded operation of the lift with respect to forward progress of a load L on the conveyor, thereby affecting placement of the engaged bottom sheet below the stack. Thus, if the bottom sheet is to have its leading edge spaced forwardly of the load, appropriate sensing apparatus may activate the lift bladder 40 to elevate the sheet against the driven rollers 34 as the load approaches the insertion station 16. The driven rollers will appropriately feed the leading edge of the sheet through the station 16 slightly ahead of the approaching load, and the remainder of the sheet will be discharged under the forwardly moving load.

In other circumstances, the load may be larger than the bottom sheets, or there may be a need simply to place bottom sheets at corners of the load. In such cases, appropriate sensing and control apparatus may be provided to time operation of the bottom sheet feed, and to appropriately position bottom sheets with respect to the feed drive 28 in order to accommodate such special requirements. Thus, using appropriate controls, several bottom sheets may be positioned and fed through the insertion station in selected patterns or relationships to accommodate particular load configurations.

Individual sheets may be delivered to the bottom sheet feeder 18 from at least one and preferably a pair of hoppers 43, 44 mounted adjacent to the frame 12. Stacks of bottom sheets may be placed in the hoppers 43, 44; to be selectively removed and placed on a bottom sheet transport 46 positioned adjacent and preferably between the hoppers 43, 44.

Individual sheets may be delivered in the FIGS. 1–12 embodiment to the bottom sheet feeder 18 from at least one and preferably a pair of hoppers 43, 44 mounted adjacent to the frame 12. Stacks of bottom sheets may be placed in the hoppers 43, 44 to be selectively removed and placed on a bottom sheet transport 46 positioned adjacent to and preferably between the hoppers 43, 44.

Individual bottom sheets S may be selectively removed from stacks within the hoppers 43, 44 by a movable suction head 48. The suction head 48 may be selectively controlled to deposit one bottom sheet at a time on the transport 46 which in turn will deliver the sheet to be engaged by the sheet feeder 18. It is also possible to operate the suction head and transport 46 in such a manner that patterns of sheets may be deposited onto the transport for movement under the conveyor 14, there to be engaged and shifted by the sheet feeder 18 under a load L passing overhead.

Figure 3:
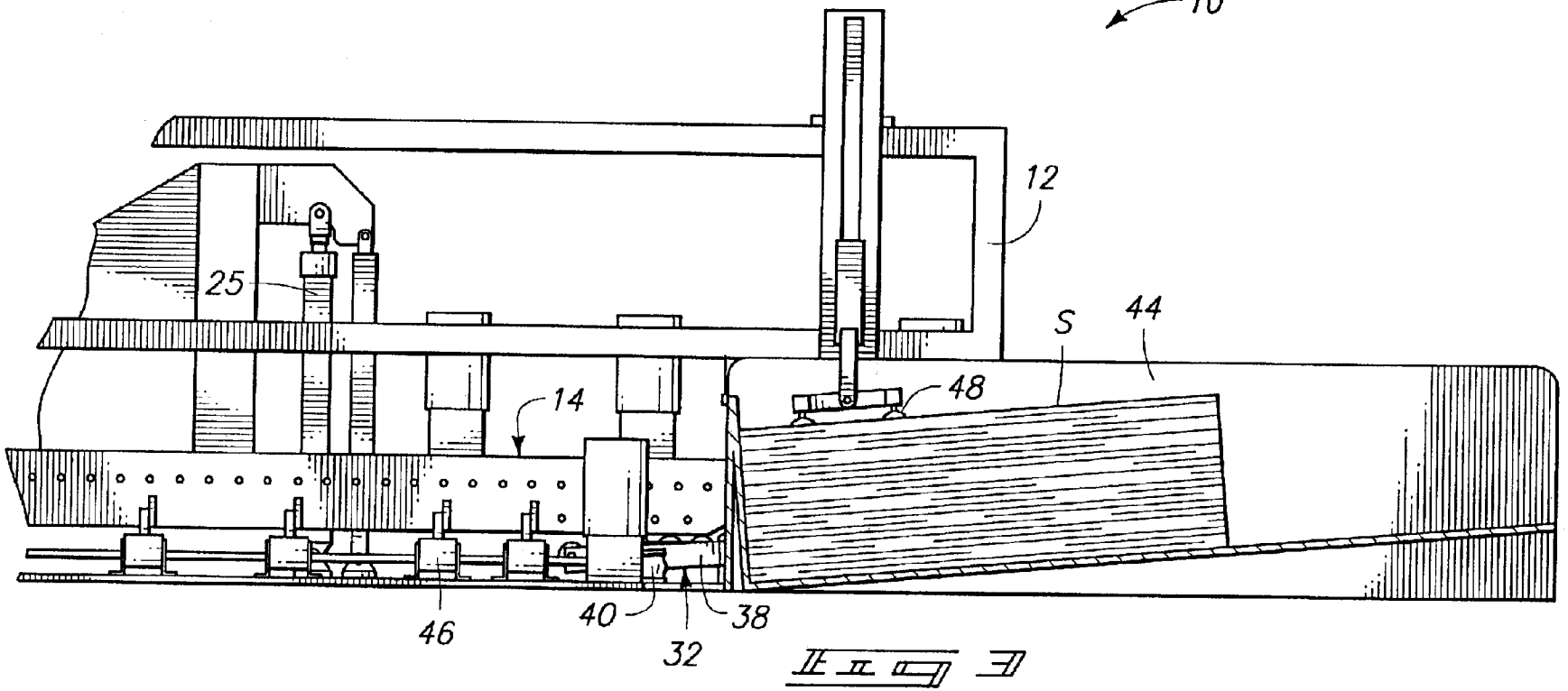
FIG. 3 is a fragmented and partially sectioned side elevation view illustrating bottom sheets in a hopper.
Figure 4:
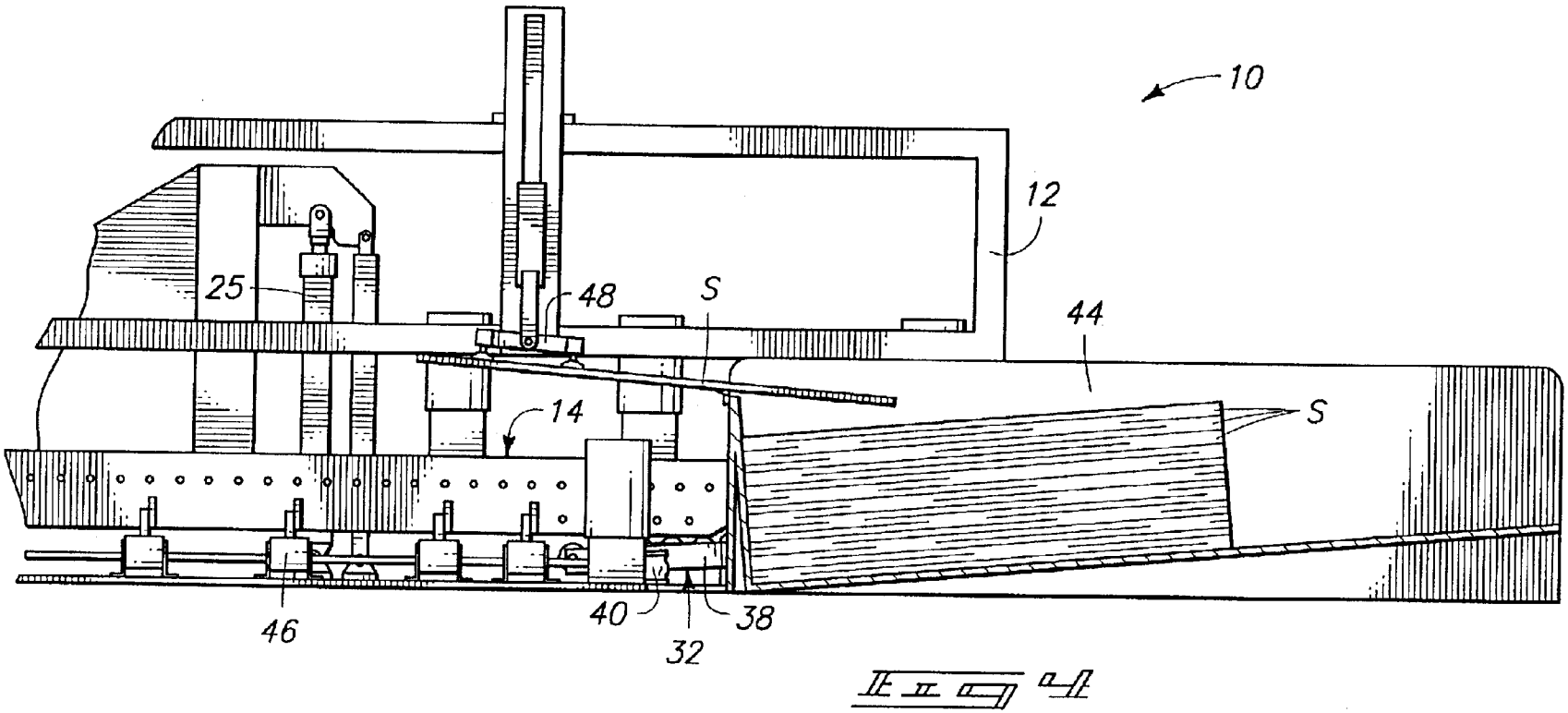
FIG. 4 is a view similar to FIG. 3 only showing a bottom sheet being lifted from the hopper.
Figure 5:
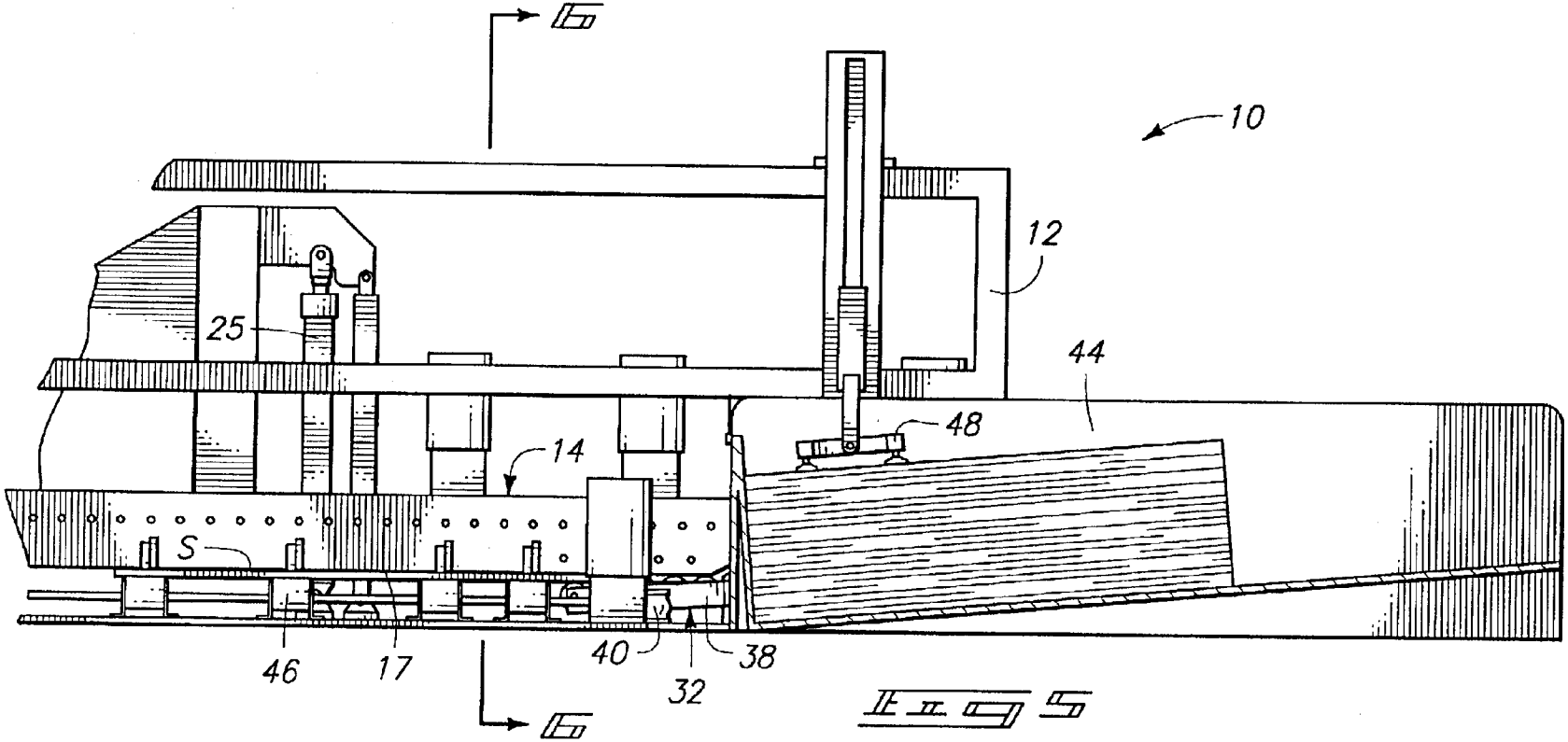
FIG. 5 is a view similar to FIG. 4 only showing the bottom sheet deposited on a bottom sheet transport.
Figure 5:
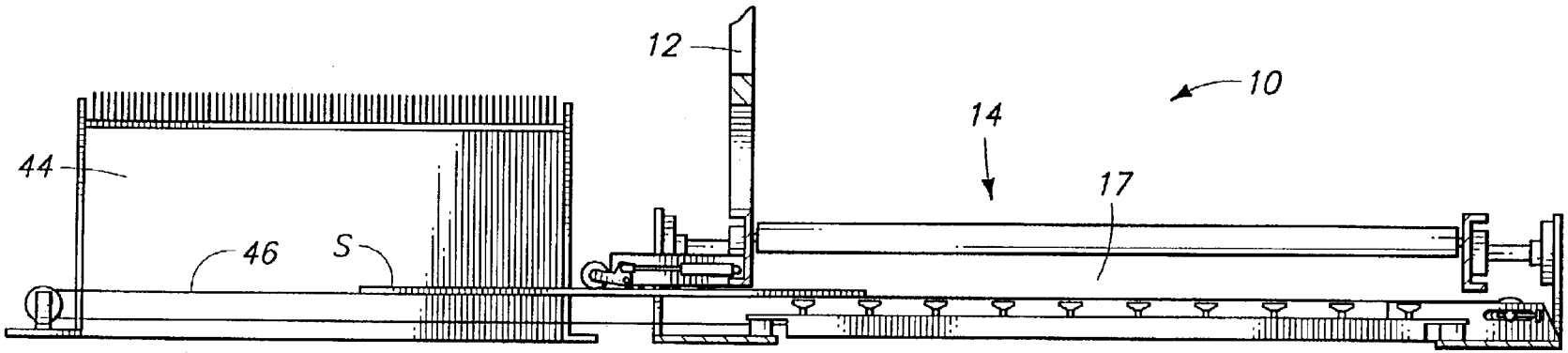
Figure 11:
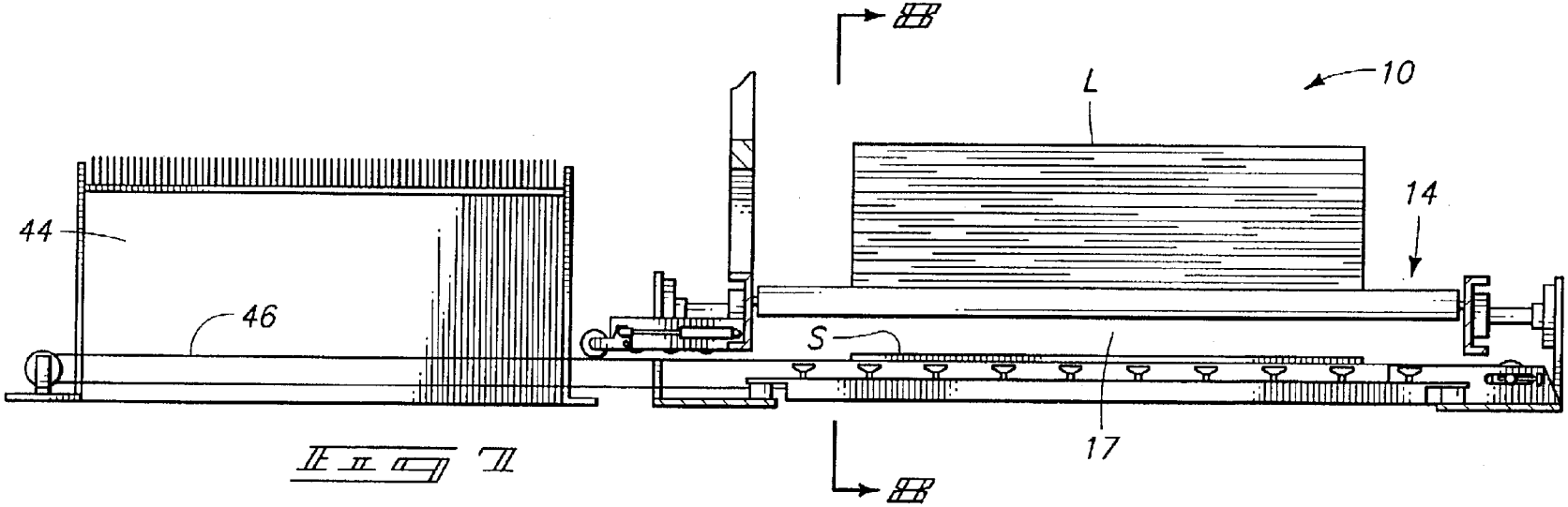
FIG. 11 is a view similar to FIG. 10 only showing the bottom sheet fully under the forwardly moving load.
Figure 11:
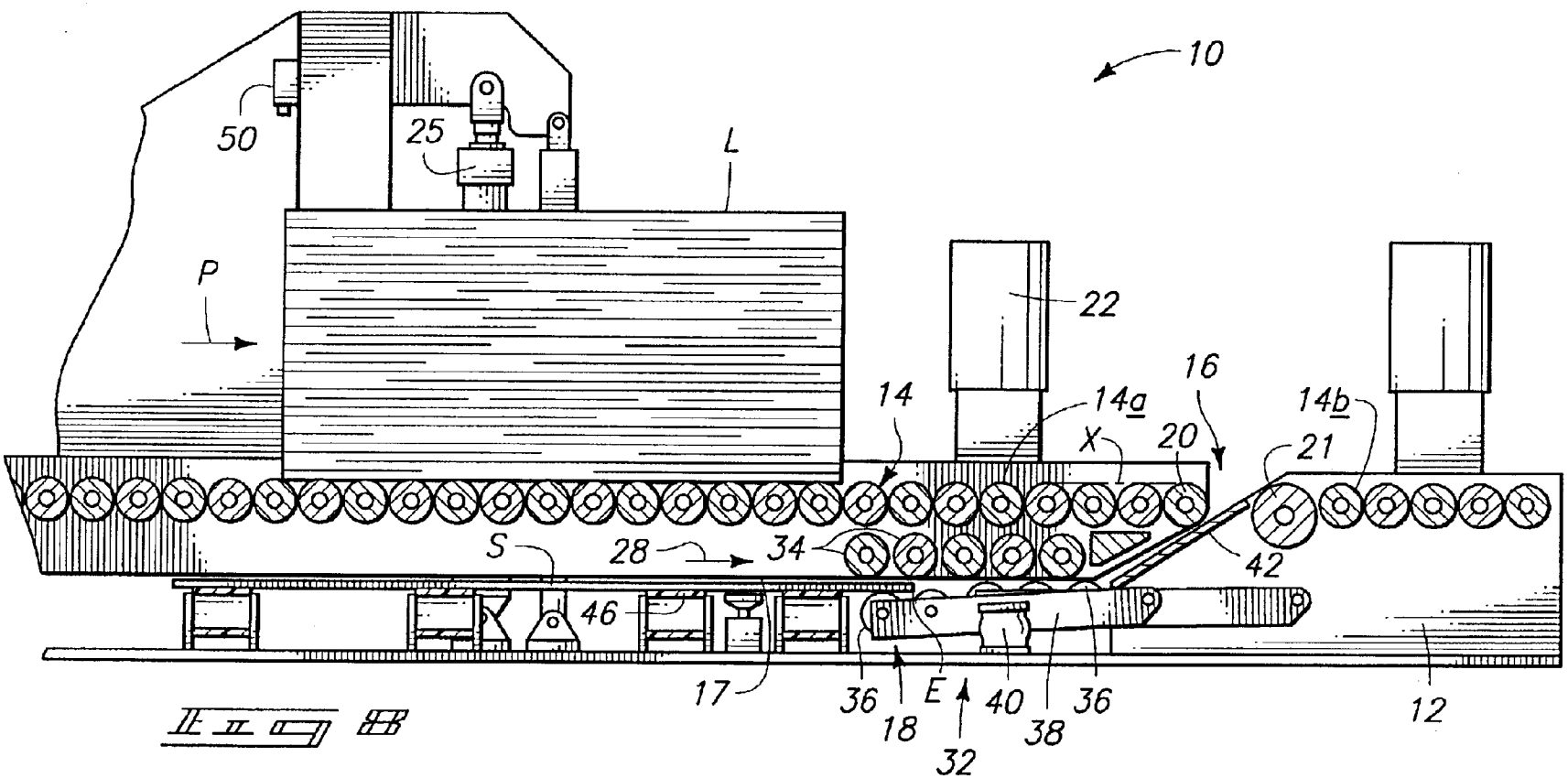
Figure 9:
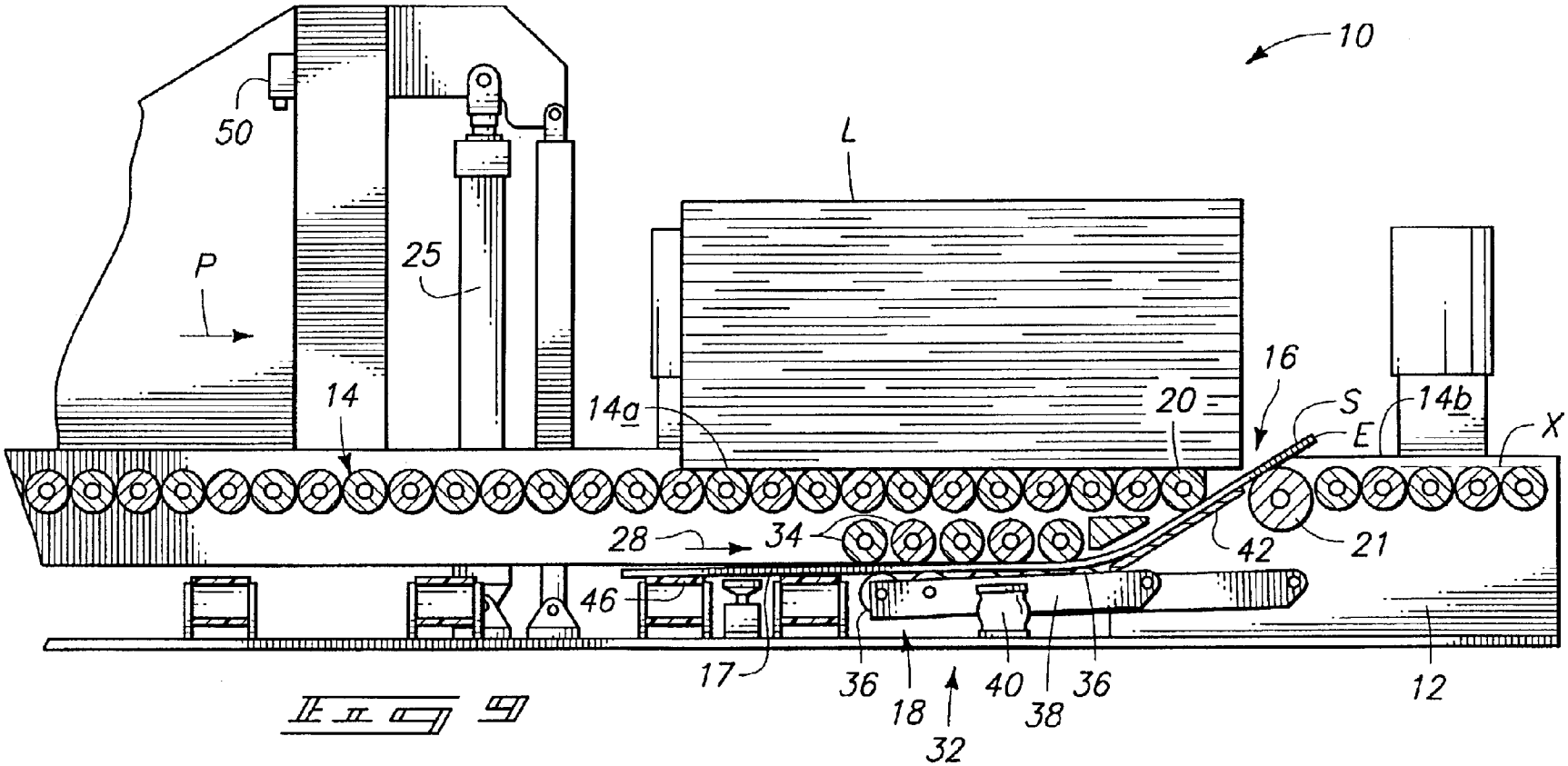
FIG. 9 is a view similar to FIG. 8 only showing the bottom sheet being shifted forwardly and upwardly through a bottom sheet insertion station.
Figure 11:
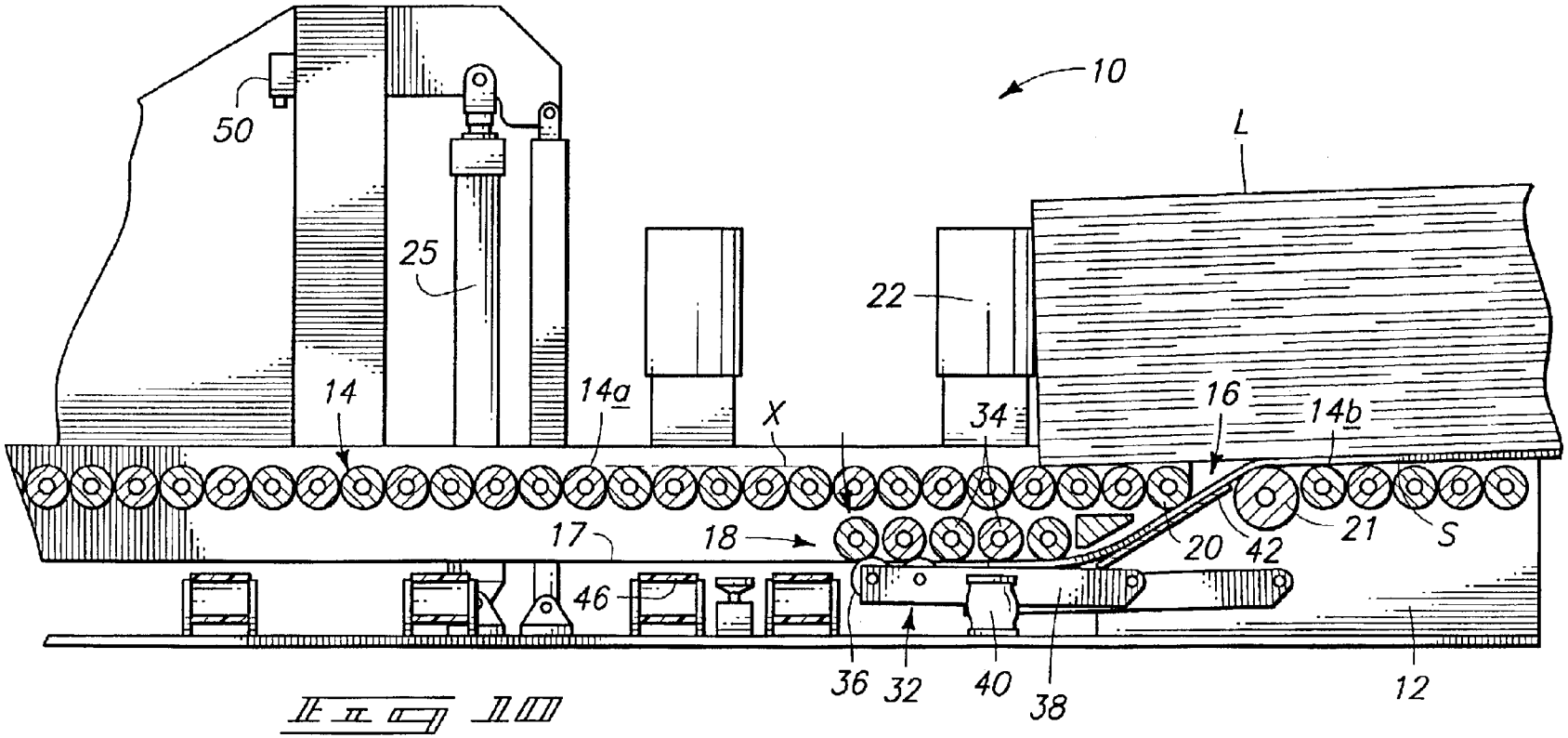
Figure 11:
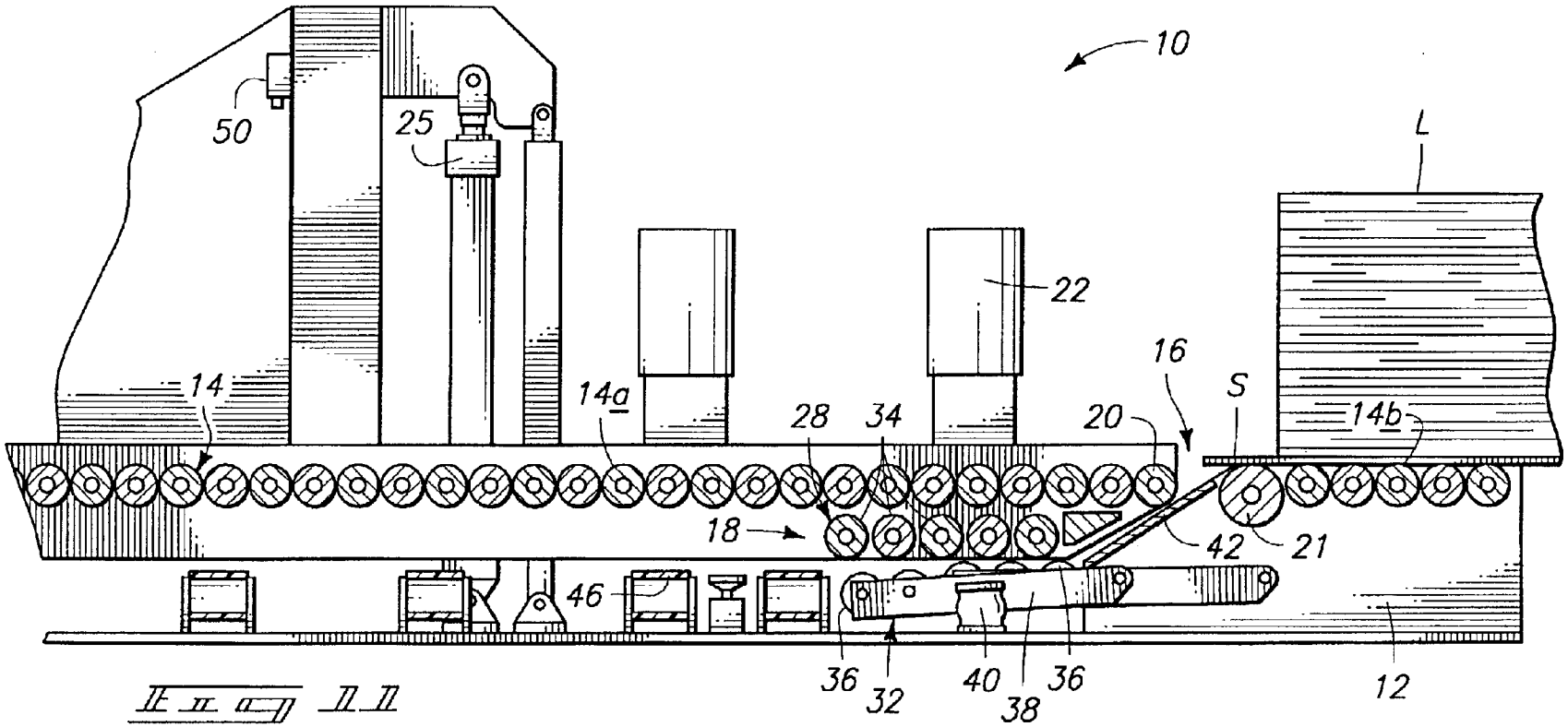
Figure 11:
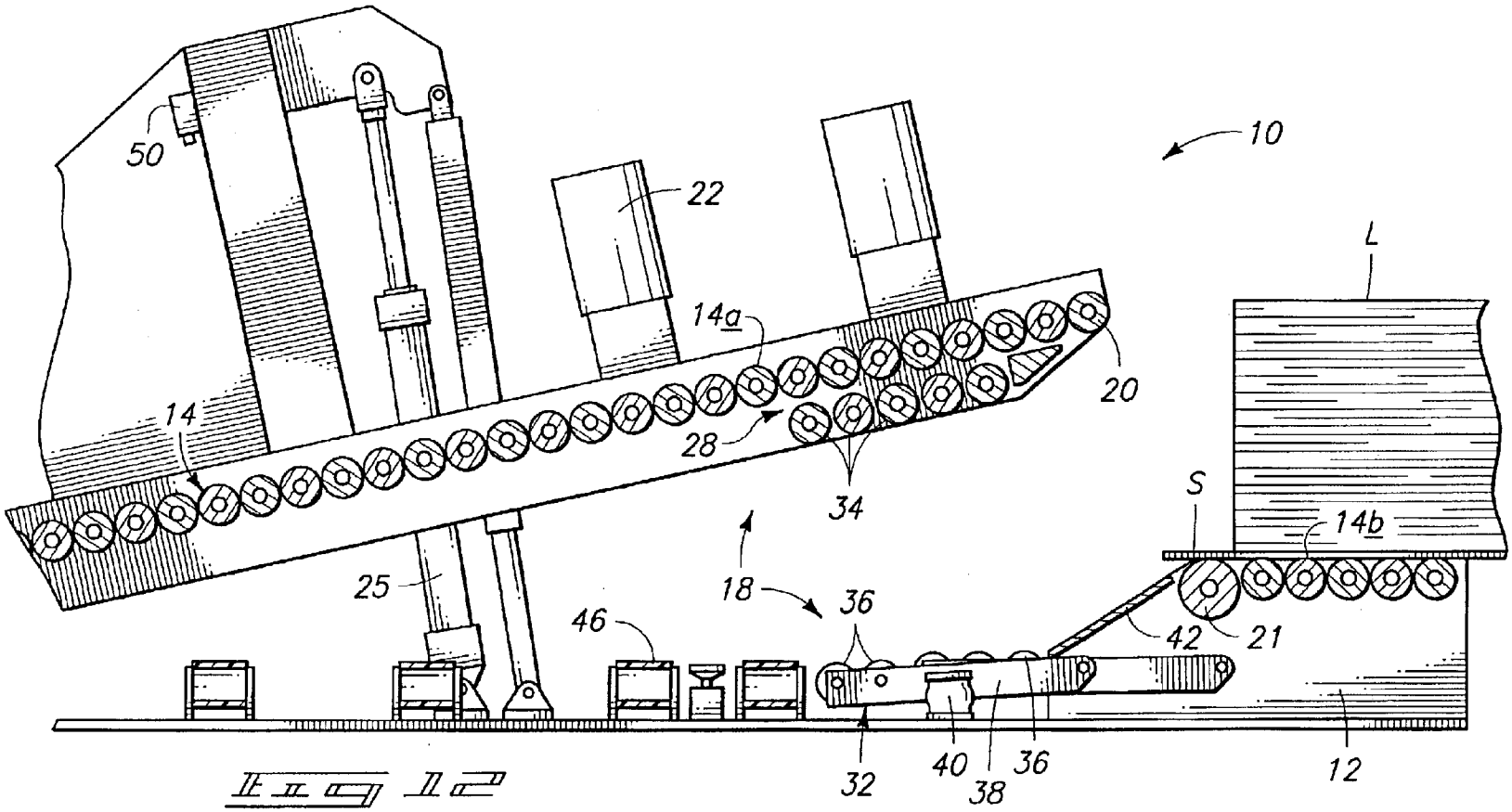
Figure 11:
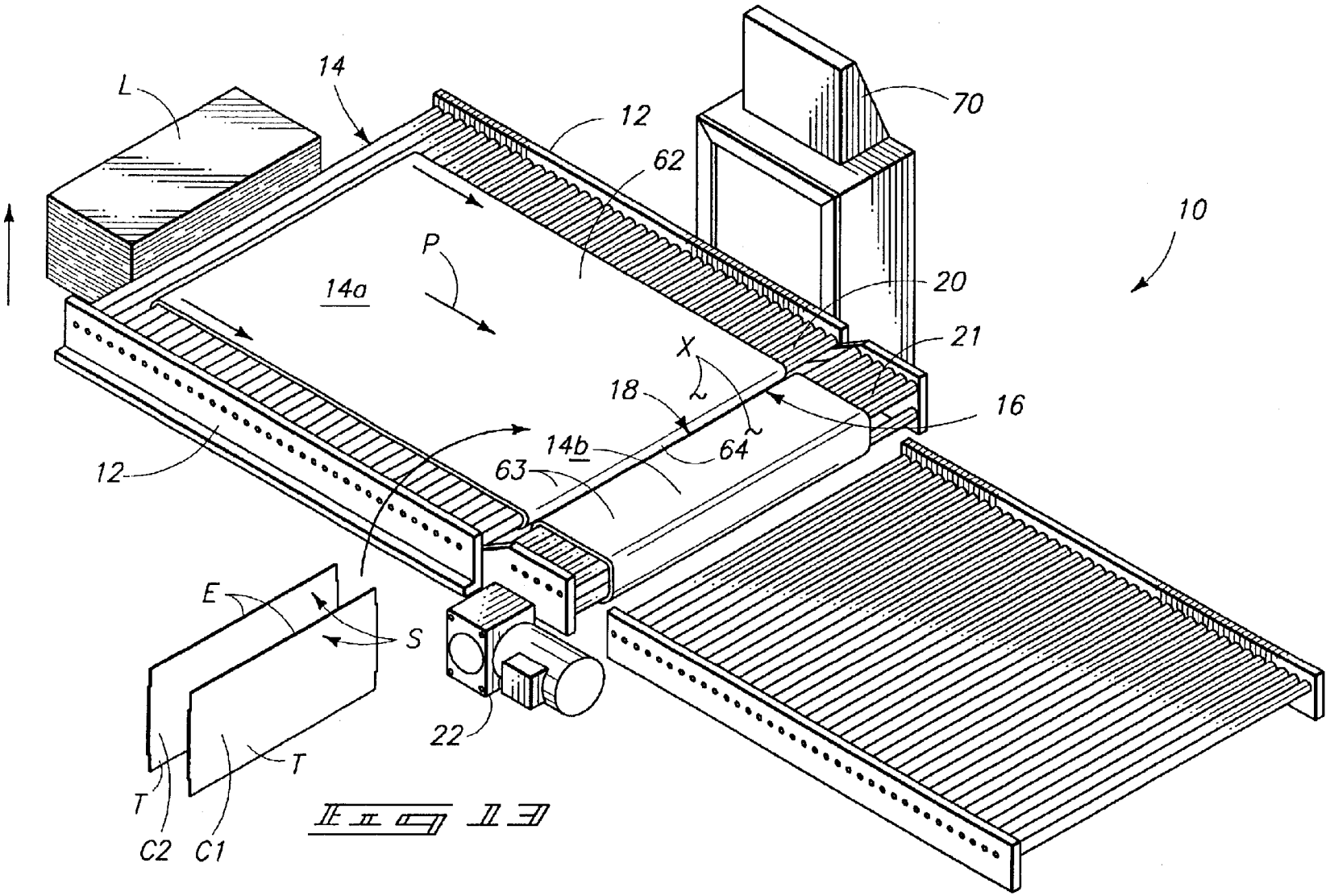
Figure 11:
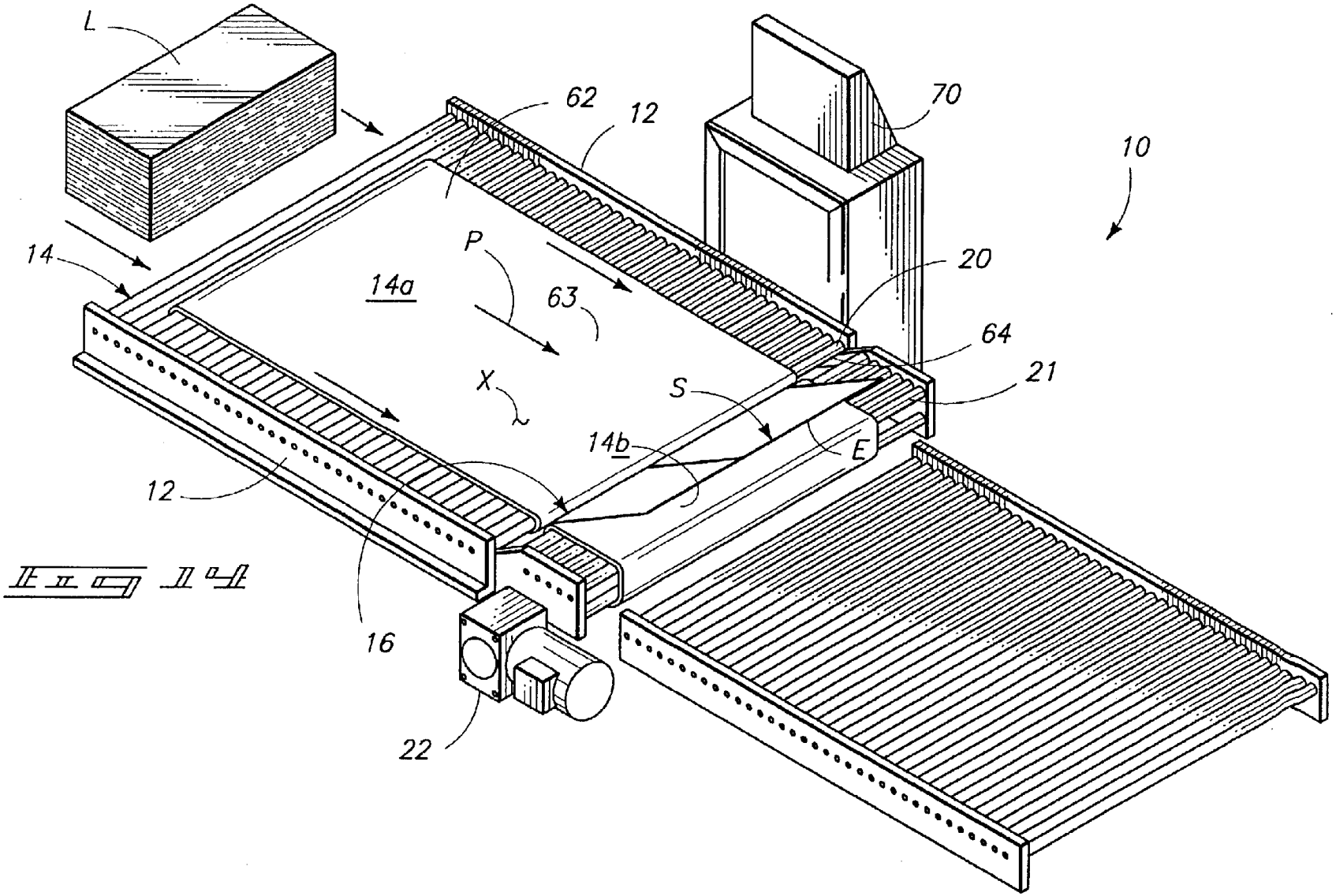
Figure 15:
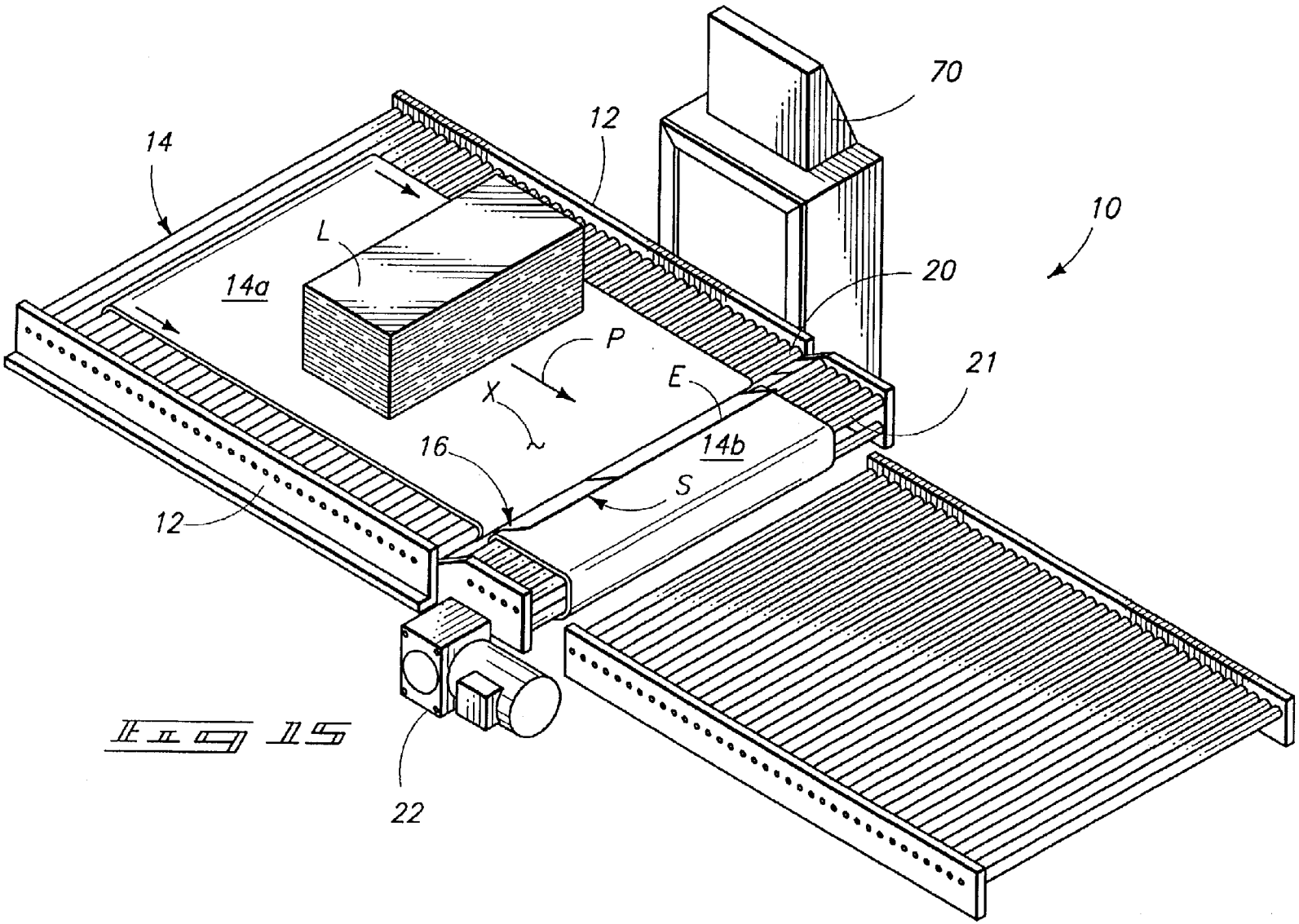
FIG. 15 is a view similar to FIG. 14 only showing a load moving on the conveyor and along a plane toward the bottom sheets awaiting in the bottom sheet receiver.
Figure 11:
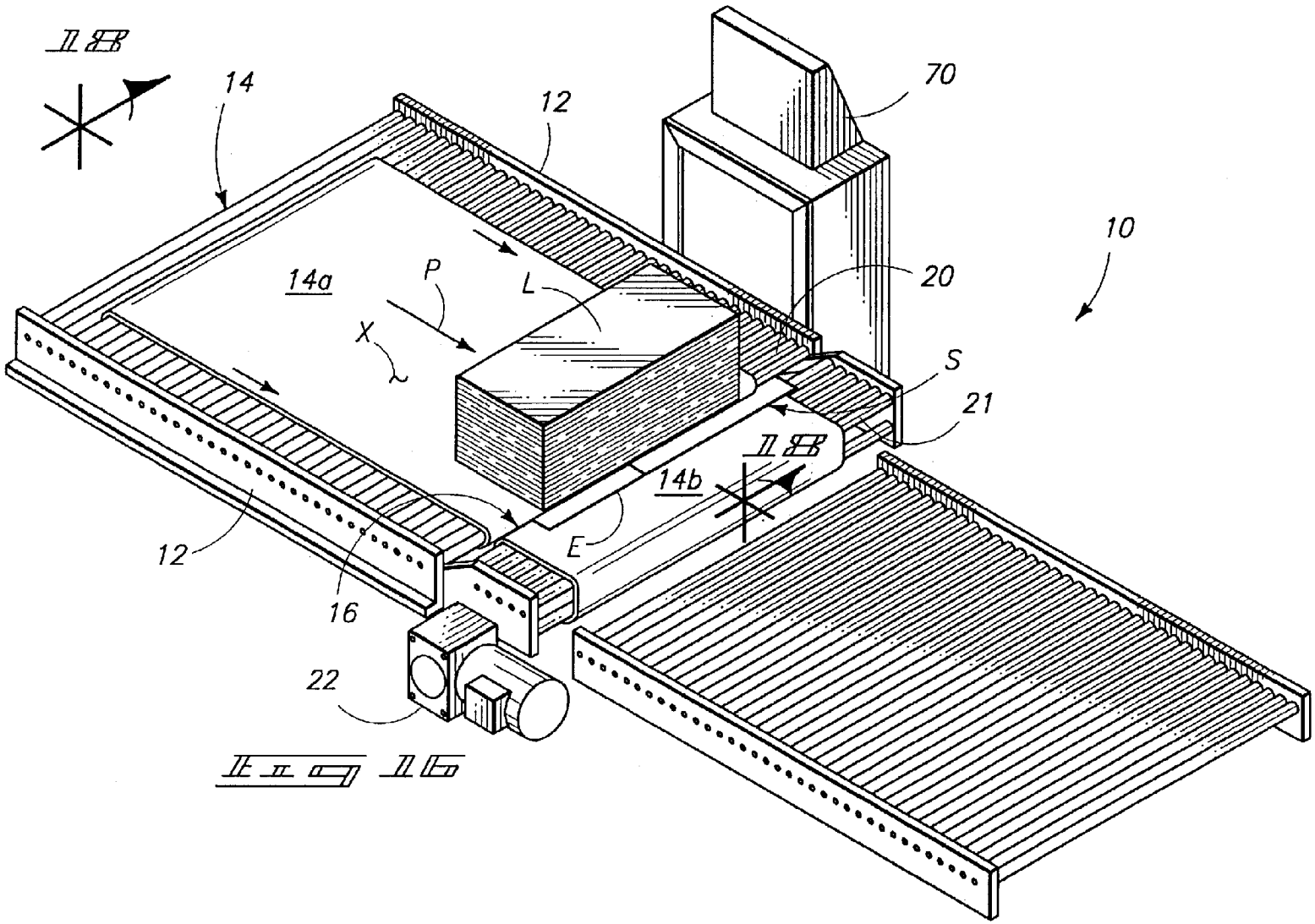
Figure 11:
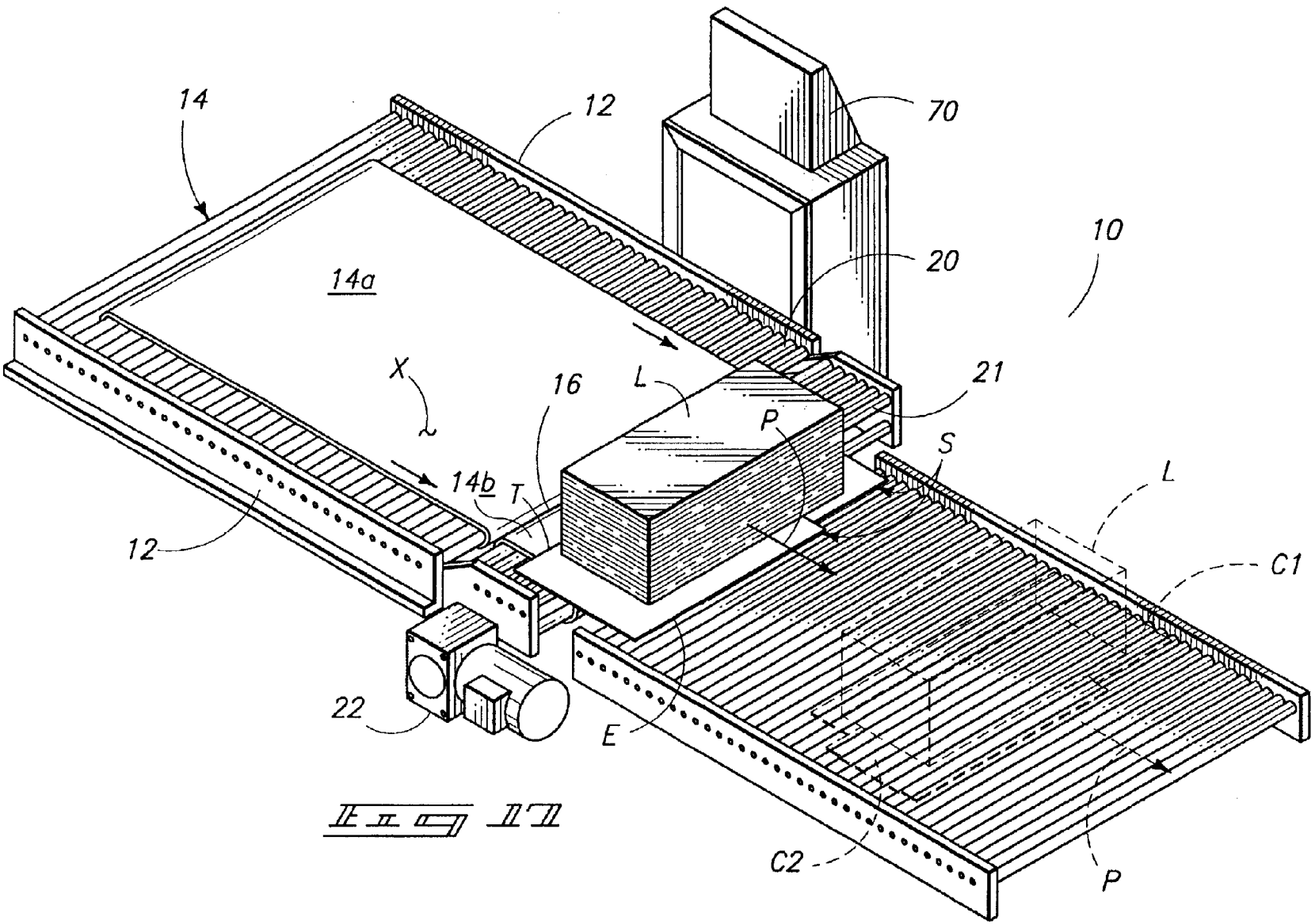
Figure 11:
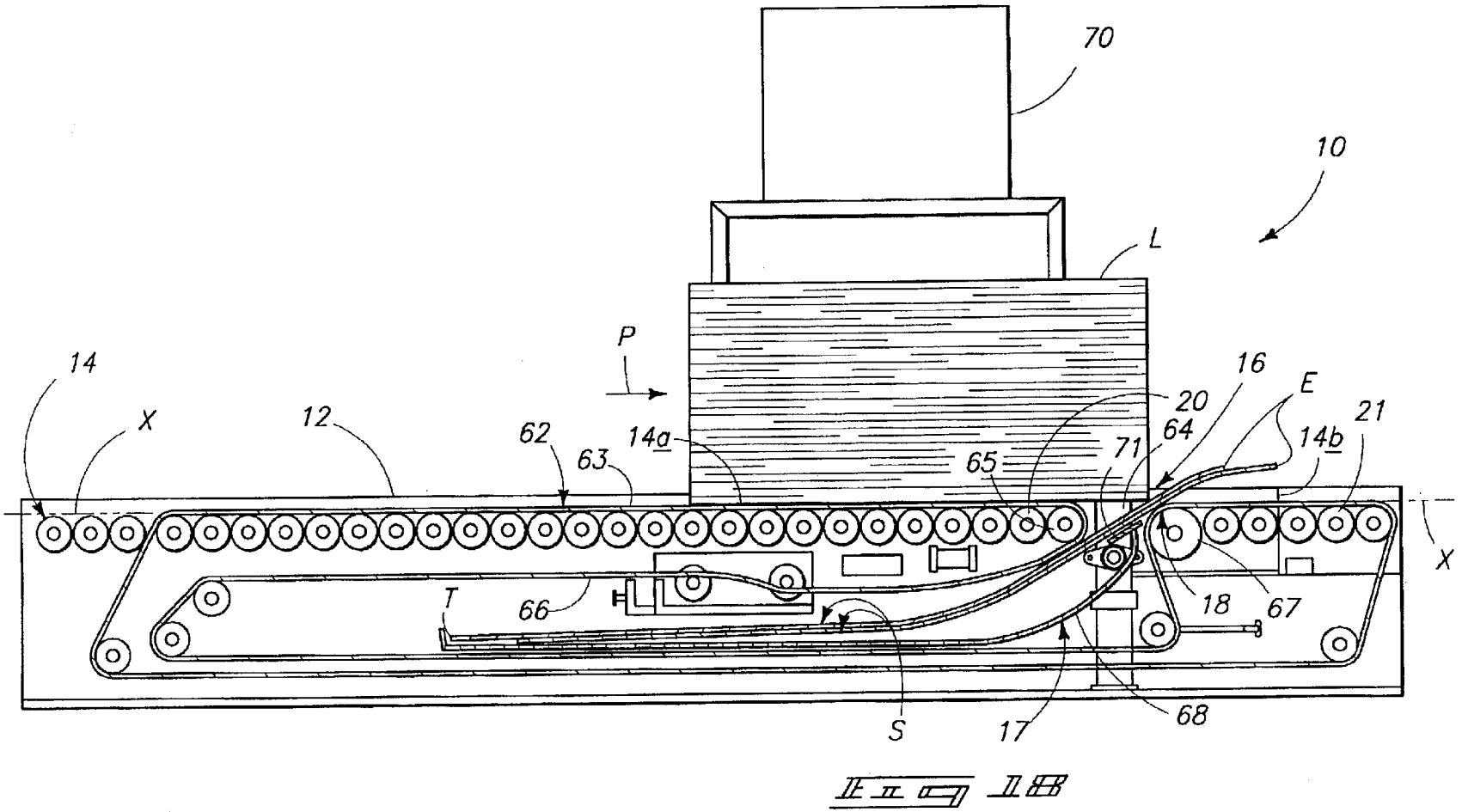

FIGS. 3–5 show the progressive removal of a bottom sheet S from a stack in one of the hoppers, and placement of the sheet S on the bottom sheet transport 46. The suction head 48 is moved over the stack in the hopper, and is lowered to engage the sheet S at the top of the stack (FIG. 3). Suction is applied to secure the sheet, and the head is raised and moved over the hopper (FIG. 4) toward the bottom sheet transport 46. FIG. 5 shows the bottom sheet deposited on the transport 46 after suction has been released, and the suction head has moved back in position to engage and move the next successive sheet to the transport.

The transport 46 (which is preferably a belt type conveyor) may be selectively operable to move the single sheet under the conveyor 14 (FIG. 6) and into position (FIGS. 7 and 8) for engagement with the sheet feeder 18. The transport may also be selectively operated in situations where more than one sheet is to be placed below a stack, and appropriate controls may be provided for that purpose. However, the basic function and intent for the transport is to deliver bottom sheets to the sheet feeder 18 for subsequent placement beneath successive loads moving by on the conveyor 14.

As the load L moves forwardly on conveyor 14, appropriate sensing or timing devices 50 may initiate operation of the sheet lift 32 to lift the leading edge of the sheet S against the set of driven rollers 34. The driven rollers 34 will move the bottom sheets S forwardly to engage the leading edge deflector 42 which will guide the bottom sheets S on forwardly and upwardly through the insertion station 16. The bottom sheets S are preferably moved at the same rate as the load L, so the load and sheets S will come together as they move forwardly, with the sheets progressively changing position from the sheet feed to a position between the load L and conveyor 14. No lifting of the load is required. Further, there is no need to stop or slow forward progress of the load while the bottom sheet is being placed.

Attention is now drawn to the preferred embodiment illustrated in FIGS. 13–18. Particular emphasis will be initially drawn to the exemplary features shown in FIGS. 13 and 18 which differ from those exemplified in the described FIGS. 1–12 embodiment.

The preferred form shown in the above figures is significantly similar to the illustrated form shown in FIGS. 1–12 and described above. However, this version is intended for smaller operations or where it may be desired to place a bottom sheet or sheets below a smaller number of loads or sheet stacks. The below described preferred form may be used for partial manual operations in which the bottom sheets are initially positioned by hand within the bottom sheet receiver 17.

The embodiment illustrated in FIGS. 13–18 may include the conveyor 14 in a belt conveyor form, in which an endless belt 62 may be trained about numerous rollers and be driven by a common conveyor drive 22. Referring to FIG. 18, it may be seen that the conveyor belt 62 extends along a working flight 63 that is coincidental with the plane X and wherein the bottom sheet insertion station 16 is situated along the working flight 63.

It may be noted that the illustrated working flight is formed by the first and second flights 14*a*, 14*b* from a single belt 62. It is possible, however to use a different belt for both flights. In both aspects, a separation between the two flights 14*a*, 14*b* defines the bottom sheet insertion station 16. Both flights may be co-planar as shown, angular, curvilinear, or combinations thereof depending upon specific applications.

It is noted that the conveyor drive 22 operates the belt conveyor 62 and, further, is the driving force for the bottom sheet feeder 18, which in this aspect may be integral with the conveyor and, more specifically, may be integrated with the second flight 14*b*. The feeder 18 may be driven by the conveyor drive 22 to initially move a bottom sheet S in the forward direction through the sheet insertion station 16 responsive to engagement of the bottom sheet by a load moving along the path. This may be understood by a review of the succession of FIGS. 13–17 and as further demonstrated by the section view in FIG. 18.

In FIG. 18, a preferred insertion station 16 is illustrated as being formed along the plane X and is provided as a bottom sheet receiving gap 64 between a pair of intermediate belt rollers 65, 67. The rollers 65, 67 are preferably located on opposite sides of the insertion station 16 and define ends of an intermediate belt part 66 that forms a partial loop between the rollers 65, 67 on one side of the plane X.

One of the rollers 67 is preferred to be used, along with the adjacent portion of the belt along the second flight 14*b*, as the bottom sheet feeder 18. This roller is most preferably situated downstream with respect to the forward direction P from the insertion station 16. The forwardly moving conveyor belt 62 at this location will engage a bottom sheet (that has been pressed against the roller by a forwardly moving load L) and will move a bottom sheet S or sheets under the load as it moves along the conveyor. This is accomplished as the load engages and presses the sheet or sheets against the belt conveyor moving over the roller 67. The forwardly moving flight 14*b*, along with the forwardly moving load will progressively pull the bottom sheet from the receiver 17 (which may be provided in the form of a tray 68 below the working flight) and onto the flight below the load L.

The tray 68 may be provided within the intermediate flight 66 and be connected to the general framework in order to receive and provide support for the bottom sheets that may be manually fed through the insertion station (gap 64).

Operation of the FIGS. 13–18 form of the bottom sheet inserter 10 may be facilitated through conventional manual and automatic controls that are not described in detail herein, but that would be well within the capability of those familiar with machine controls. An operator thus may have a control station 70 provided alongside the inserter. Controls may be provided at the station 70 to start, stop and allow selection of a chosen operating mode.

It may be desirable, for example, to provide for an accumulation of several stacks or loads on the conveyor; with one or more bottom sheets to be placed under the accumulated load(s). This may be done by manually switching the drive 22 on and off, or by providing a mode selection based on appropriate sensor input that could count to a desired number of loads accumulating on the conveyor upstream of the bottom sheet insertion station 16. Thus, a load or an accumulation of loads may be acquired on the conveyor upstream of the station 16 before the bottom sheet or sheets are placed at the sheet receiver 17. When the desired number of stacks or loads are accumulated on the belt, the operator or appropriate sensing controls may stop the drive to halt forward progress of the load(s) and to give the operator time to place one or more bottom sheets into the sheet receiver 17.

The bottom sheet(s) may be manually inserted through the gap 64 and into the tray 68 while the conveyor 14 is inactive. It is preferred that the leading edge(s) E of the sheet(s) project above the plane X and in the forward path P of the accumulated load. More than one sheet may be placed in any selected pattern, with the bulk of the sheets being received in the tray 68 upstream of the insertion station 16.

A flipper 71 may be provided at the insertion station 16, adjacent the feed roller 67. The flipper may be used to initially hold the bottom sheet away from engagement with the feed roller until such time that the leading edge engages that part of the bottom sheet exposed above the plane X. Appropriate controls may be provided to shift the flipper and allow the bottom sheet to come into contact with the conveyor belt moving over the roller 67 so that the sheet is pinched between the forwardly moving load and the forwardly moving conveyor flights 14*a*, 14*b*. The sheet(s), being engaged on both sides by forwardly moving surfaces (the load and the second flight 14*b*) will be pulled from the receiver and under the load as the load moves along the forward path and further onto the second flight 14*b*.

The process may take place without requiring that the load be lifted from the conveyor 14. Further, the sequence may occur without significantly interrupting forward progress of loads from upstream processing operations.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A bottom sheet inserter, comprising:

a frame;

a first conveyor flight on the frame defining a path for a load and operable to move the load in a forward direction along the path to a bottom sheet insertion station; and a second conveyor flight on the frame along the path and downstream of the bottom sheet insertion station and operable to move the load in said forward direction from the bottom sheet insertion station;

a bottom sheet feeder adjacent the bottom sheet insertion station operable to feed a bottom sheet from the bottom sheet insertion station onto the second conveyor flight and under a load moving onto the second conveyor flight; and wherein the second conveyor flight is a belt conveyor; and a leading edge deflector positioned between the bottom sheet feeder and bottom sheet insertion station.

2. A bottom sheet inserter, comprising:

a frame;

a first conveyor flight on the frame defining a path for a load and operable to move the load in a forward direction along the path to a bottom sheet insertion station; and a second conveyor flight on the frame along the path and downstream of the bottom sheet insertion station and operable to move the load in said forward direction from the bottom sheet insertion station;

a bottom sheet feeder adjacent the bottom sheet insertion station operable to feed a bottom sheet from the bottom sheet insertion station onto the second conveyor flight and under a load moving onto the second conveyor flight;

wherein:

the conveyor flights are comprised of rollers and the bottom sheet insertion station is defined between selected rollers of the first and second conveyor flights.

3. A bottom sheet inserter as defined by claim 2, wherein:

the bottom sheet feeder includes a feed drive positioned to move a bottom sheet in the forward direction through the bottom sheet insertion station.

4. A bottom sheet inserter as defined by claim 2, wherein the bottom sheet feeder is positioned below the first conveyor flight and includes a feed drive operable to move a bottom sheet in the forward direction through the sheet insertion station.

5. A bottom sheet inserter as defined by claim 2, wherein:

the bottom sheet feeder is positioned below one of the first and second conveyor flights and includes a feed drive and sheet lift positioned to move a bottom sheet upwardly an in the forward direction through the sheet insertion station.

6. A bottom sheet inserter as defined by claim 2, wherein:

the bottom sheet feeder includes a feed drive comprised of a set of driven rollers mounted on the frame, and a sheet lift positioned to move a bottom sheet against the driven rollers, whereby the engaged bottom sheet is moved in the forward direction through the sheet insertion station.

7. A bottom sheet inserter, comprising:

a frame;

a first conveyor flight on the frame defining a path for a load and operable to move the load in a forward direction along the path to a bottom sheet insertion station; and a second conveyor flight on the frame along the path and downstream of the bottom sheet insertion station and operable to move the load in said forward direction from the bottom sheet insertion station;

a bottom sheet feeder adjacent the bottom sheet insertion station operable to feed a bottom sheet from the bottom sheet insertion station onto the second conveyor flight and under a load moving onto the second conveyor flight, and wherein the second conveyor flight is a belt conveyor and the bottom sheet feeder is positioned upstream of the bottom sheet insertion station and further comprises a leading edge deflector positioned between the bottom sheet feeder and bottom sheet insertion station.

8. A bottom sheet inserter as defined by claim 1, further comprising:

a pair of bottom sheet hoppers adjacent the frame; and a bottom sheet transport positioned between the pair of bottom sheet hoppers and adjacent the frame.

9. A bottom sheet inserter as defined by claim 2, further wherein the bottom sheet insertion station is defined between a roller on the first conveyor flight and an adjacent roller on the second conveyor flight; and wherein the bottom sheet feeder includes the roller on the second conveyor flight.

10. A process for inserting a bottom sheet below a load, comprising:

moving the load on a first conveyor flight along a path in a forward direction to a bottom sheet insertion station;

moving the load past the bottom sheet insertion station and onto a second conveyor flight downstream of the first conveyor flight;

progressively moving a bottom sheet under the load from the bottom sheet insertion station as the load moves onto the second conveyor flight such that the load becomes supported on the sheet and the bottom sheet becomes supported on the second conveyor flight;

wherein the second conveyor flight is a belt conveyor; and pressing the bottom sheet against a feed conveyor; and operating the feed conveyor to move the bottom sheet through the bottom sheet insertion station and under the load as the load moves forwardly.

11. A process for inserting a bottom sheet below a load, comprising:

moving the load on a first conveyor flight along a path in a forward direction to a bottom sheet insertion station;

moving the load past the bottom sheet insertion station and onto a second conveyor flight downstream of the first conveyor flight;

progressively moving a bottom sheet under the load from the bottom sheet insertion station as the load moves onto the second conveyor flight such that the load becomes supported on the sheet and the bottom sheet becomes supported on the second conveyor flight;

wherein the second conveyor flight is a belt conveyor;

moving the bottom sheet from at least one of two hoppers, to a sheet feeder positioned under at least one of the conveyor flights; and operating the sheet feeder to move the sheet forwardly through the sheet insertion station to position the bottom sheet under the load.

12. A process for inserting a bottom sheet below a load as defined by claim 10, further comprising:

moving the bottom sheet from a hopper situated to one side of the conveyor flights to a sheet feeder positioned under the first conveyor flight; and operating the sheet feeder to move the sheet forwardly and upwardly through the sheet insertion station to position the bottom sheet in the path of the load moving forwardly on the first conveyor flight.

13. A process for inserting a bottom sheet below a load as defined by claim 10, wherein progressively moving the bottom sheet includes:

manually moving the bottom sheet to a sheet receiver positioned under the first conveyor flight; and positioning leading edge of the bottom sheet in the path.

14. A bottom sheet inserter, comprising:

a frame;

a belt conveyor on the frame including first and second conveyor flights defining a path for a load and operable to move the load in a forward direction along the path and substantially in a plane;

a bottom sheet insertion station along the conveyor between the first and second conveyor flights;

a bottom sheet receiver adjacent the bottom sheet insertion station, configured to receive and orient a bottom sheet through the bottom sheet insertion station in the path of a load on the conveyor with a leading edge of the bottom sheet projecting above the plain and a trailing edge situated below the plane; and a bottom sheet feeder adjacent the receiver and operable to feed the bottom sheet onto the second conveyor flight and beneath the load.

15. A bottom sheet inserter as defined by claim 14, wherein the first and second flights are formed by a common belt.

16. A bottom sheet inserter as defined by claim 14, wherein:

the conveyor includes a conveyor drive and wherein the conveyor drive also drives the bottom sheet feeder to move a bottom sheet in the forward direction through the sheet insertion station.

17. A bottom sheet inserter as defined by claim 14, wherein:

the conveyor is an endless belt conveyor with the first and second flights formed along the plane and wherein the flights are separated along said plane to form a bottom sheet receiving gap between a pair of intermediate rollers on opposite sides of the bottom sheet insertion station and defining ends of an intermediate flight that forms a partial loop about the bottom sheet receiver between the intermediate rollers and to one side of the plane.

18. A bottom sheet inserter as defined by claim 14, wherein:

the bottom sheet feeder is positioned downstream with respect to the forward direction from the bottom sheet insertion station.

19. A bottom sheet inserter as defined by claim 14, wherein the conveyor includes a conveyor belt movable in said forward direction along said plane and wherein the bottom sheet feeder is comprised of a conveyor roller engaging the conveyor belt and rotatably positioned downstream of the insertion station to engage and move the bottom sheet under a load moving along the conveyor.

20. A bottom sheet inserter as defined by claim 14, wherein the bottom sheet receiver includes a tray positioned below the first conveyor flight.

21. A process for inserting a bottom sheet below a load, comprising:

moving the load on a first flight of a conveyor along a plane in a forward path of travel;

placing a bottom sheet at a bottom sheet insertion station under the first flight and with a leading edge of the bottom sheet projecting above the plane and in the forward path;

engaging the bottom sheet by the load and moving the bottom sheet against a second conveyor flight that extends forwardly of the first flight from the bottom sheet insertion station; and progressively moving the bottom sheet under the load and onto the second flight as the load moves along the forward path of travel such that the load becomes supported on the bottom sheet and second flight; and wherein the second conveyor flight is a belt conveyor; and stopping forward progress of a load on the first flight; and positioning the bottom sheet at the bottom sheet insertion station forward of the stopped load.

22. A process for inserting a bottom sheet below a load, comprising:

moving the load on a first conveyor flight along a path in a forward direction to a bottom sheet insertion station;

moving the load past the bottom sheet insertion station and onto a second conveyor flight downstream of the first conveyor flight;

progressively moving a bottom sheet under the load from the bottom sheet insertion station as the load moves onto the second conveyor flight such that the load becomes supported on the sheet and the bottom sheet becomes supported on the second conveyor flight; and wherein the conveyor flights are comprised of rollers and the bottom sheet insertion station is defined between selected rollers of the first and second conveyor flights.

* * * * *

UNITED STATES PATENT AND TRADEMARK OFFICE

CERTIFICATE OF CORRECTION

PATENT NO. : 6,899,512 B2
DATED : May 31, 2005
INVENTOR(S) : Curtis A. Roth

It is certified that error appears in the above-identified patent and that said Letters Patent is hereby corrected as shown below:

Column 10,
Line 10, replace "positioning leading edge of the bottom sheet in the path." with -- positioning a leading edge of the bottom sheet in the path. --.

Signed and Sealed this

Eleventh Day of April, 2006

JON W. DUDAS
*Director of the United States Patent and Trademark Office*